United States Patent [19]

Berfield

[11] Patent Number: 4,984,328

[45] Date of Patent: Jan. 15, 1991

[54] DRIP CLEANER ATTACHMENT WITH SOLID CLEANING CONCENTRATE

[75] Inventor: Robert C. Berfield, Jersey Shore, Pa.

[73] Assignee: Shop-Vac Corporation, Williamsport, Pa.

[21] Appl. No.: 499,800

[22] Filed: Mar. 27, 1990

[51] Int. Cl.[5] ..... A47L 7/00

[52] U.S. Cl. ..... 15/322; 15/321

[58] Field of Search ..... 15/321, 322

[56] References Cited

U.S. PATENT DOCUMENTS

| | | | |
|---|---|---|---|
| 965,315 | 7/1910 | Moorhead | 15/322 |
| 1,676,905 | 7/1928 | King . | |
| 2,799,534 | 7/1957 | Norden et al. | 299/83 |
| 3,586,012 | 6/1971 | Paule | 134/93 |
| 4,307,484 | 12/1981 | Williams | 15/322 X |
| 4,333,203 | 6/1982 | Yonkers | 15/321 |
| 4,335,486 | 6/1982 | Kochte | 15/322 X |
| 4,534,083 | 8/1985 | Hampson | 15/321 |
| 4,775,104 | 10/1988 | Harkins | 239/314 |
| 4,887,330 | 12/1989 | Woodhall et al. | 15/322 |

*Primary Examiner*—Chris K. Moore

*Attorney, Agent, or Firm*—Ostrolenk, Faber, Gerb & Soffen

[57] ABSTRACT

The disclosure concerns a drip cleaning attachment for use in association with a suction cleaner. A housing with a suction nozzle also has supported, at its rear, a liquid drip nozzle which drips liquid toward the surface to be cleaned through a liquid distribution screen. A non-liquid, and particularly a solid rod, cleaning concentrate is supported on the screen. Some of the liquid hitting the screen migrates to the cleaning concentrate rod, dissolves some of it and the concentrate drips to the surface to be cleaned. A scrub brush may be disposed on the attachment for scrubbing the surface.

13 Claims, 3 Drawing Sheets

DRIP CLEANER ATTACHMENT WITH SOLID CLEANING CONCENTRATE

BACKGROUND OF THE INVENTION

The present invention relates to a drip cleaning attachment for attachment to a vacuum cleaner, suction cleaner, or the like, wherein liquid, and particularly water or water mixed with a cleaning concentrate, such as a detergent, is dispensed to a surface to be cleaned, such as a carpet, floor, upholstery, or the like, and then the liquid, any dirt dissolved in the liquid and dirt on the surface are suctioned from the surface.

Various drip cleaning attachments to a vacuum cleaner intake hose are background to this invention. For example, see U.S. application Ser. No. 282,103, filed Dec. 9, 1988 and see U.S. application Ser. No. 358,248, filed May 26, 1989. These drip attachments to a vacuum cleaner hose share a number of characteristics. There is a common housing for the drip unit and for the suction inlet. That common housing is attached to a wand that is in turn attached to the inlet end of a conventional suction hose leading to the vacuum cleaner. The liquid drip dispenser is positioned in the common housing adjacent to the suction nozzle and usually a short distance behind the suction inlet, so that they are near enough to make the entire housing somewhat compact in shape for appearance and function purposes. The width of the drip outlet from the drip dispenser is substantially the same as the width of the suction inlet, as they are in the same housing.

The liquid and the cleaning concentrate to be dispensed by the drip unit may be supplied from various sources. Supply of liquid from a stationary water supply, like a faucet, through a hose to the drip unit is shown in U.S. application Ser. No. 358,248, filed May 6, 1989. Supply of cleaning liquid from a tank mounted on the wand or on the drip attachment is shown in U.S. application Ser. No. 282,103, filed Dec. 9, 1988. The drip attachment includes appropriate means for dispersing the liquid supply over the entire width of the drip outlet. See e.g. the cascade or waterfall in U.S. application Ser. No. 282,103.

The present invention is concerned with the supply of cleaning concentrate, such as detergent, soap, floor cleaner, carpet shampoo, upholstery shampoo, or the like, to the surface to be cleaned. It is known to supply a preformed mixture of water or cleaning solution and cleaning concentrate in a desired mixture ratio and to drip that onto the surface, as from a supply tank. Providing a tank of liquid, like mixed liquid and cleaning concentrate, in a tank on the wand has the obvious limitation that the supply cannot be so large as to make the attachment very heavy. Therefore, the liquid supply will likely be exhausted after a short time and must be replenished frequently, causing possible user inconvenience.

An alternative is to connect a conventional water supply, e.g. from a faucet or tap, through a unit which dispenses detergent, shown, for example in U.S. application Ser. No. 358,248, and the flowing water supply picks up detergent from the detergent supply, and this mixture is then dripped through the unit.

If the liquid is supplied from a remote liquid source, like a faucet or even a supply tank, and if the liquid from the source is to pick up cleaning concentrate in its flow path, there is sometimes a problem of adjusting the ratio between the liquid and the cleaning concentrate so as to obtain the desired cleaning without wasting concentrate or providing too much concentrate. Systems which mix water and cleaning concentrate shortly before dispensing can be complicated and unreliable, and unless the system is constantly observed, the desired ratio of liquid to concentrate mix is not obtained.

There can be a serious problem if the liquid cleaning concentrate backs up into the water supply due to a negative pressure condition such as, a back flow that may occur when the water supply is shut off. In some countries and in some municipalities, no attachment may be made to a water supply which adds chemicals to the outflowing water from the supply unless there is a sufficient spacing between the water supply and the cleaning concentrate to prevent contamination due to back flow.

Where liquid cleaning concentrate is used, there are dangers of spillage, leakage, possible freezing and other liquid handling and storage problems. Finally, wherever liquid concentrate is mixed with a supply of flowing liquid and then they move together through a tube or pipe, the pipe is filled with the cleaning concentrate. In order to prevent contamination and to ensure proper system performance, the tubing, conduits, valves, etc. for the concentrate and for the mixture of cleaning concentrate and liquid must be cleaned and flushed, requiring extra work for the user.

SUMMARY OF THE INVENTION

Accordingly, it is the primary object of the invention to simplify the addition of a cleaning concentrate to a flow of liquid of a liquid dispensing attachment for the intake hose and suction nozzle of a vacuum cleaner or suction cleaner.

It is another object of the invention to avoid the possible difficulties that can be encountered when a liquid form of a cleaning concentrate supply is used for a drip attachment.

Another object of the invention is to avoid the possibility that the cleaning concentrate might back flow into the liquid supply due to negative pressure, as when the liquid supply is cut off.

A further object of the invention is to eliminate the need for flushing tubing, conduits, valves, and the like and associated parts, to clean out cleaning concentrate after the liquid dispensing and suctioning attachment has been used.

The present invention provides a liquid dispensing and liquid and dirt vacuum cleaning and suctioning attachment for the intake hose of a vacuum cleaner or suction cleaner. The front of the attachment, which is normally the side away from the user in use, has a suction intake nozzle which is narrow front to back and is wide side to side. That nozzle suctions dirt and liquid from the surface, floor, carpet, upholstery, etc. being cleaned. To the rear of the suction inlet is an essentially open region. The open region has a liquid dispersing or distributing means, in the form of a grid or screen, at its bottom, spaced a short distance above the surface to be cleaned. A liquid supply connected with any continuous or large supply of water or other liquid, which is not yet mixed with cleaning concentrate, has an outlet in the form of a spray nozzle, which is directed to spray or drip the liquid on the liquid spreading, dispersing and distributing grid or screen.

When it is desired to mix a cleaning concentrate with the liquid, such as water, that is being dripped onto the liquid distributing screen, the invention contemplates positioning a non-liquid, and particularly a solid rod, stick, or the like piece of cleaning concentrate at, or preferably directly on, the distributing means or screen. The liquid, such as water, being sprayed onto or dripped onto the distributing means screen partially drips or is even sprayed onto the cleaning concentrate rod or drips or migrates along the distributing means screen to the rod where it dissolves some of the solid concentrate from the rod. The now liquefied cleaning concentrate drips through the distributing means screen to supply the liquid concentrate to the surface being cleaned. The rear of the housing for the drip or spray nozzle dispensing to the distributing means screen and for the cleaning concentrate rod may be open to permit access to the distributing means for installation or removal of the cleaning concentrate rod, although the rear of that housing may be closed for appearance or safety reasons.

A scrub brush may be supported behind the liquid distribution means so that when the attachment is moved back and forth over the surface, the surface may be scrubbed to rub in the liquid and the dripped cleaning concentrate to improve the cleaning action.

The user may, of course, merely use the dripped liquid, without the cleaning concentrate, by removing the solid rod of cleaning concentrate from the distributing means. The user may also eliminate use of the cleaning liquid by simply shutting off the liquid or water supply while still having use of the suction nozzle. Since the cleaning concentrate is liquefied by the liquid from the water supply, shutting off the liquid or water supply also shuts off the delivery of the dissolved cleaning concentrate to the surface.

The invention has the important benefit of avoiding any possibility that any of the cleaning concentrate chemicals could back flow into the water or liquid supply due to any negative pressure in that supply. The invention also avoids the need for possibly costly, certainly complicated, and possibly unreliable means for blending water or liquid with a cleaning concentrate or shampoo to obtain a desired ratio of mixture. With the invention, the more water or liquid that is dispensed, the more of it migrates to the cleaning concentrate rod and the more of the cleaning concentrate is dispensed, so that there is an approximately uniform ratio between dispensed liquid or water and cleaning concentrate that is provided by the invention. If the user wishes to clean a particularly soiled or stained small area, the user can remain at that area and direct the water supply perhaps to deliver a more highly concentrated ratio of cleaning concentrate to water, by angling the attachment so that more of the water falls on the cleaning concentrate rod. This is one possibility of control over the liquid supply through appropriate handling of the attachment.

Because the cleaning concentrate reserve is a solid stick or rod, it can be seen, especially when the rear of the attachment is open, but it could be seen even if the rear of the unit is closed if the rear of the unit is transparent or if a user looks inside. The remaining reserve of cleaning concentrate in the form of the rod is apparent, and the user can determine when to replace the cleaning concentrate supply.

The invention has the important benefit that none of the cleaning concentrate or shampoo will pass through tubing or valves along the dispensing attachment or even in the liquid supply, so that there will be a minimum of cleaning or flushing needed after use or if the cleaning concentrate is changed or removed. This makes the attachment of the invention quite simple to use.

Other objects and features of the invention will become apparent from the following description of a preferred embodiment of the invention considered in conjunction with the accompanying drawings.

DESCRIPTION OF A PREFERRED EMBODIMENT

Figure 1:
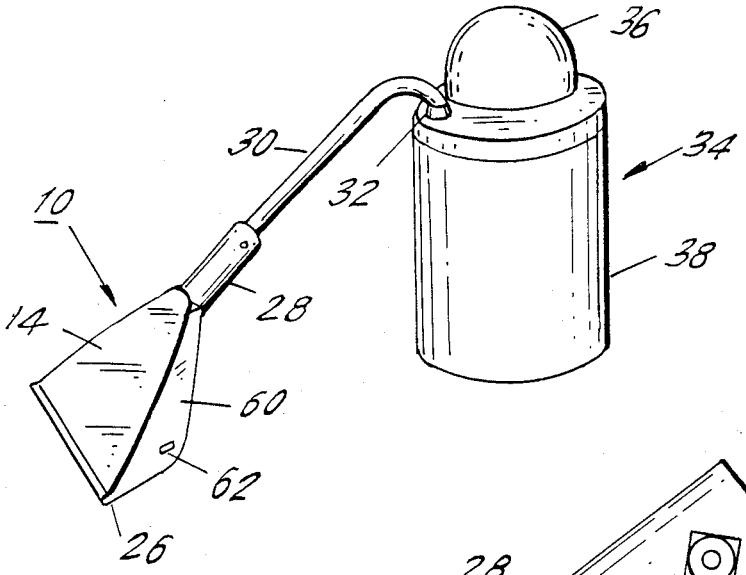
FIG. 1 is a view of a suction cleaner with the attachment of the invention.
Figure 2:
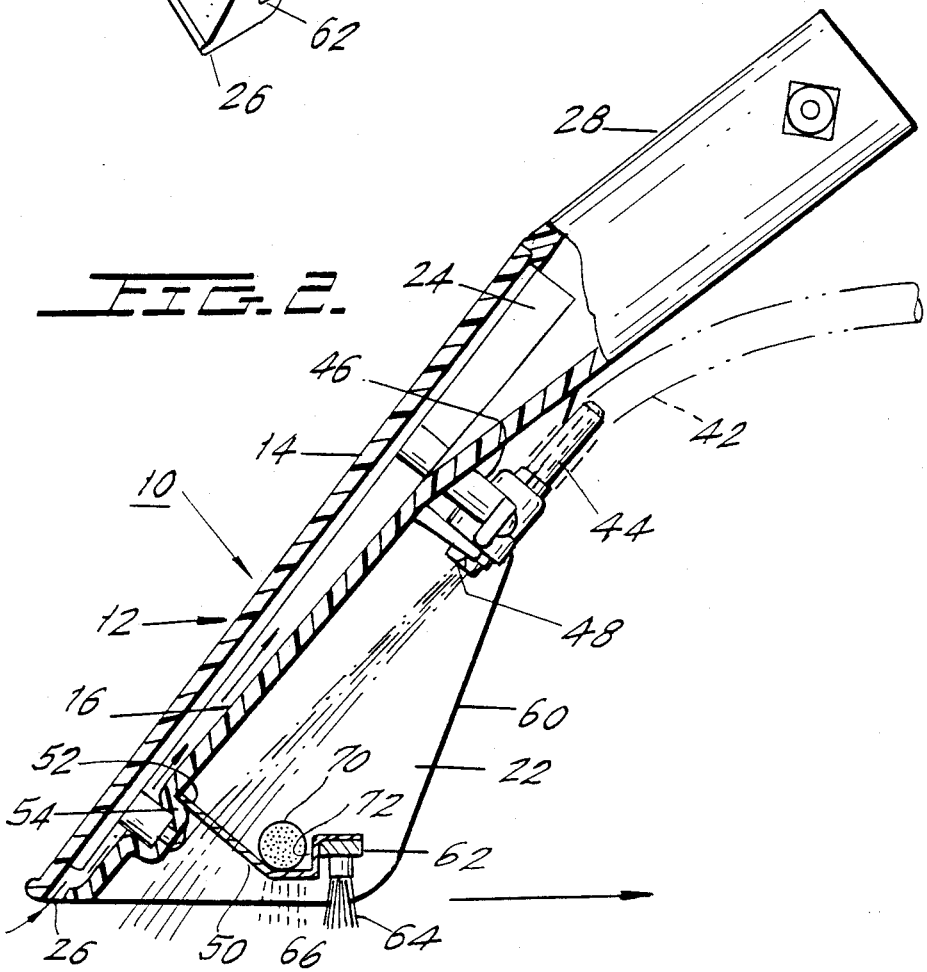
FIG. 2 is a side cross-sectional view of an attachment of the invention.
Figure 3:
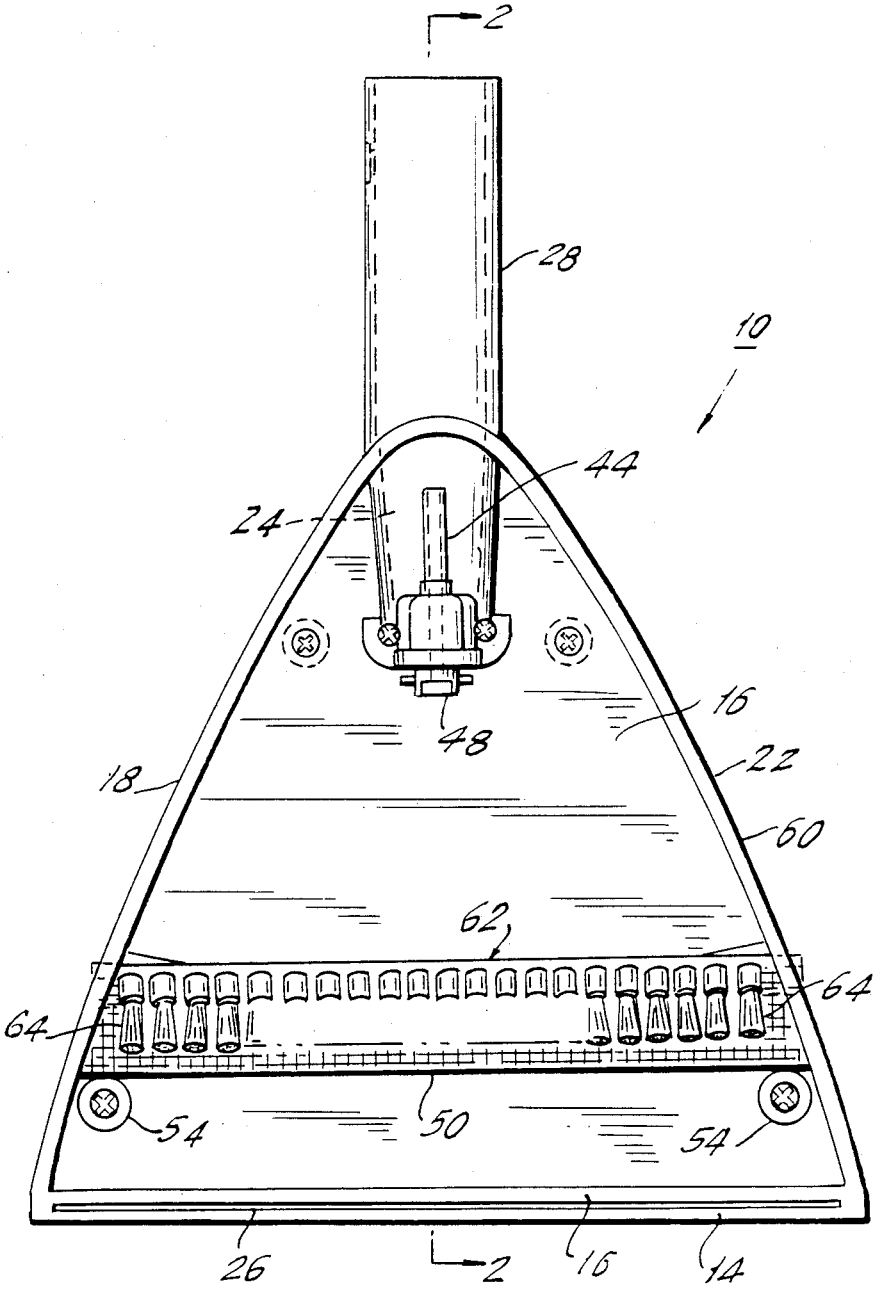
FIG. 3 is a rear view thereof.
Figure 4:
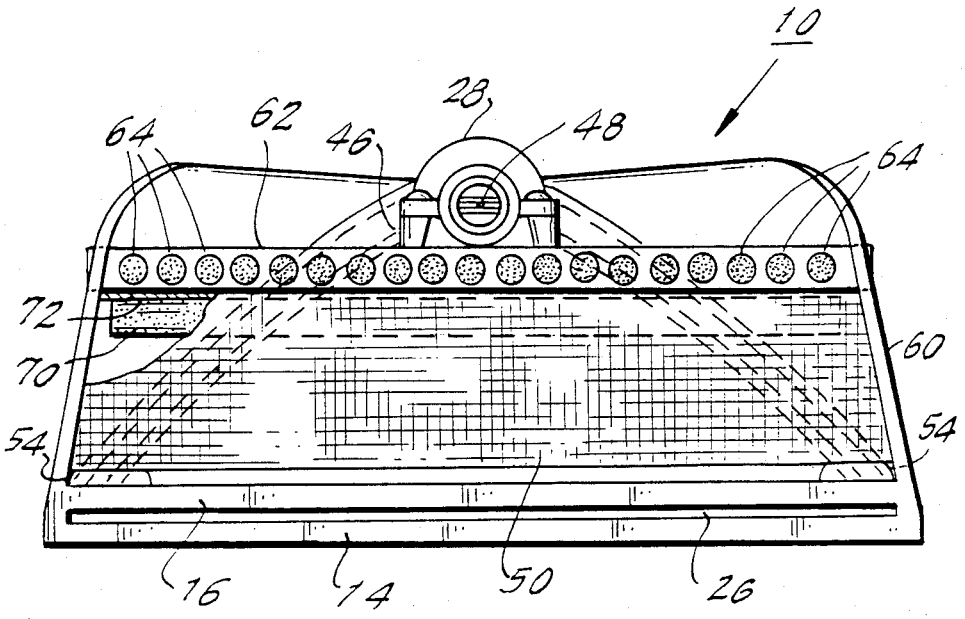
FIG. 4 is a bottom view thereof.

The liquid dispensing and suctioning attachment 10 of the present invention includes a unitary housing 12 which has a front wall 14 that defines the front side of an air inlet suction nozzle, a rear wall 16 that defines the rear wall of that suction nozzle, and which has side walls 18 and 22 that extend past the front and rear walls 14 and 16 and rearwardly of the wall 16. The walls 14, 16, 18 and 22 together define the suction inlet passage 24 which begins at the inlet nozzle 26 that is narrow front to back and rather wide from side to side on the housing 12. The suction inlet passage 24 gradually widens front to back and narrows side to side above the inlet nozzle 26. At its top, the passage 24 merges into and enters the outlet fitting 28, which is in turn connected into the hose 30 that leads to the inlet 32 of a conventional wet/dry electric vacuum cleaner 34, not described in detail but known to persons skilled in the art. Such a vacuum cleaner has a suction motor 36, which sucks air into its inlet 32 from the hose 30, and suctioned dirt and liquid collect in the tank 38 of the suction cleaner.

The invention resides in the liquid dispensing and distribution means and in the cleaning concentrate supply. Liquid supply to the liquid dispensing means is from a conventional water supply, like a faucet or tap in house or building or a large remote tank. The water supply communicates through the flexible tube 42 to the rigid inlet fitting 44 that is rigidly supported on a shelf 46 that is, in turn, secured to the rear wall 16 of the housing 12. The fitting 44 delivers liquid to the liquid drip or spray nozzle 48, and the nozzle is shaped, e.g. it is wide side to side and narrow front to back, so as to spray liquid over the full width of the liquid distribution means 50. That liquid would normally fall or drip to the surface being cleaned just to the rear of the suction nozzle inlet 26.

In order to disperse and distribute the liquid, e.g. water, across the full width of the attachment housing 12 behind the suction inlet 26, there is supported at and behind the rear wall 16 a liquid distributing or dispersion means in the form of a wide pore grid or screen 50 of metal wire, plastic filament, or the like, whose pores are wide enough not to interfere with the throughflow of the liquid or water, but which has a small enough mesh that enough water strikes the screen filaments to be distributed across the width of the dispensing screen substantially uniformly. Some of the water stays on the screen filaments and migrates along them primarily to wet the cleaning concentrate rod and dissolve it, as described below. The front edge 52 of the screen 50 is supported on the protruding supports 54 at the suction nozzle rear wall 16. The screen extends rearwardly, and inclined downwardly with the attachment normally held for use, past the normal drip or spray distribution pattern of the liquid through the screen 50, for reasons to be discussed.

The area beneath the nozzle 48 where the screen 50 is located is bounded at its lateral sides by the side panels 60, which are extended parts of the walls 18, 22. The panels 60 support the screen 50, partially enclose the screen and provide a protected region, so that a user's hand or other objects in the vicinity would not enter into the area through which liquid or water is being sprayed. A conventional bristle type scrub brush 62 is supported on the side panels 60, and its bristles 64 extend down beneath the bottom of the panels 60 so as to enable the user to scrub the surface, carpet, or the like, to help remove dirt, stains, etc.

There is disposed at the distribution means, and particularly on the screen 50 at its rear region 66, which is rearward of the normal spray pattern of the nozzle 48, a non-liquid supply, and particularly a rod or stick 70 of a cleaning concentrate, such as a carpet cleaning shampoo, a surface cleaning detergent, soap, or whatever concentrated material should be mixed with the liquid or water to produce an effective liquid cleaner for the surface being cleaned. A person skilled in the art knows of or can easily develop an appropriate concentrate material for use in cleaning carpets, upholstery, floor surfaces, or the like, such that the concentrate is solid before it is exposed to liquid or water and is gradually dissolved inward from its periphery in liquid, like water. As liquid or water wets the cleaning concentrate rod, the drops of liquefied cleaning concentrate drip off the rod through the rear area 66 of the screen 50 and onto the surface being cleaned. The area 66 of the screen may be defined at a pocket 72 which is formed in the screen 50 at the area 66 just forward of the brush 62 by appropriate bending and shaping of the screen.

The screen 50 is a good vehicle for distribution of the liquid or water and for also supporting the rod 70 because some of the liquid sprayed onto the screen will reach the cleaning concentrate rod due to splash and some through gravity moving the liquid or water down along the screen to the rod and some through capillary action.

The screen 50 is supported to be oriented to be tilted downwardly and rearwardly when the attachment 10 is held in its normal orientation of use. This enables the liquid or water that stays on the screen filaments to migrate under the force of gravity rearwardly to the rod 70. The liquid or water migrates down along the screen, contacts the cleaning concentrate rod and dissolves or otherwise releases some of the concentrate. The dissolved concentrate then drips or dispenses off the rod through the screen at 66 and onto the surface to be cleaned. The main liquid or water spray passing through the screen 50 also splashes onto the surface. Because of the user's normal back and forth movement of the cleaning attachment, the dripped water will mix with the dripped cleaning concentrate and further distribute it over the surface being cleaned. Together they dissolve or loosen dirt on the surface and the scrubbing brush 62 may loosen and help raise the dirt off the surface. When the surface has been cleaned enough, the attachment 10 is moved so that the suction inlet 26 is over the liquid and the dirt, and the vacuum cleaner 34 sucks up the mixed liquid and dirt through the attachment 10 and hose 30.

If a particularly dirty or soiled area is to be cleaned, a greater concentration of the cleaning concentrate or detergent should be applied on that area. The user can move the attachment so that the cleaning concentrate rod 70 and the screen region 66 are over the area to be cleaned and can let the attachment stay there while dispensing the liquid or water and cleaning concentrate. More concentrated cleaning concentrate will be deposited on the particularly dirty area. Then that area can be brushed with brush 62 to remove the dirt. The regular liquid or water spray can be moved over the area to mix with the previously dispensed concentrated detergent and dissolve it and rinse it away and enable the surface to be suctioned clean thereafter. Obviously, should the user wish to wash the surface with liquid or water, without detergent, the cleaning concentrate rod 70 can be easily removed.

For convenience, there is no closing panel over the rear edges of the side panels 60, enabling easy access to the cleaning concentrate rod 70 for its end placement and removal as desired. A covering may be applied over the back of the unit, if desired. Preferably, the entire attachment, or at least the area near the cleaning concentrate rod is transparent, e.g. made of transparent material, so that the rod 70 can be observed, and as the rod of cleaning concentrate becomes exhausted, a new rod may be installed.

Although the dispensing means is illustrated as a nozzle 48, other means may be used for distributing the liquid supply, including a cascade or waterfall arrangement, as shown in U.S. application Ser. No. 282,103. It is preferable to simplify the dispensing means 48 and the distribution means 50, and it is preferable that whatever distribution means is used, it delivers the liquid to the solid rod of cleaning concentrate.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A drip cleaner attachment for connection to a suction cleaning apparatus, or the like, the attachment comprising:

a housing having a suction inlet, a suction outlet for connection to a suction cleaner, a suction passage through the housing between the suction inlet and the suction outlet, whereby material may be suctioned from a surface through the suction inlet to the suction cleaner;

liquid dispensing means supported at the housing and comprising means for receiving liquid from a liquid supply and for dripping the liquid toward an area on the surface that is near the surface area to be suctioned by the suction inlet;

liquid distribution means supported at the housing in the drip pathway of the liquid from the dispensing means, the distribution means being adapted for permitting the dripped liquid to pass therethrough to the surface to be cleaned, the distribution means including means which receives and transmits some of the liquid dripped on the distribution means away from the location where the liquid is dripped on the distribution means;

a non-liquid supply of cleaning concentrate supported at the liquid distribution means at a location such that the distribution means transmits some of the liquid which contacts the distribution means to the non-liquid cleaning concentrate supply for wetting the non-liquid cleaning concentrate supply with the liquid and for dissolving some of the concentrate, the concentrate supply being supported above the surface such that the dissolved concentrate will drip to the surface.

2. The attachment of claim 1, wherein the liquid distribution means comprises a porous screen supported at the housing and the non-liquid concentrate supply is supported at the screen for the liquid to travel along the screen to the non-liquid concentrate supply.

3. The attachment of claim 2, wherein the screen provides the support for the non-liquid concentrate supply and the non-liquid concentrate supply sits on the screen, whereby liquid transmitted along the screen reaches the non-liquid concentrate supply supported thereon.

4. The attachment of claim 3, wherein the non-liquid concentrate supply is removable from and placeable on the screen.

5. The attachment of claim 2, wherein the dispensing means comprises a nozzle shaped and positioned to aim a primary spray of liquid across an area of the screen, and the screen is inclined so that in normal use, the non-liquid concentrate supply is out of the normal liquid drip path and below the area where the liquid is dripped on the screen so that liquid will migrate down along the screen to the non-liquid concentrate supply.

6. The attachment of claim 2, wherein the dispensing means comprises a nozzle shaped and positioned to aim a primary spray of liquid across an area of the screen, and the screen is shaped so that in normal use, the non-liquid concentrate supply is out of the normal liquid drip path, the screen being adapted so that liquid will migrate along the screen to the non-liquid concentrate supply.

7. The attachment of claim 1, wherein the non-liquid cleaning concentrate comprises a solid rod, or the like, of concentrate which extends across the attachment and is exposed over its length across the attachment to the liquid that is being distributed by the distribution means, and the distribution means is shaped for supplying liquid to the rod over the length of the portion of the rod that extends across the attachment.

8. The attachment of claim 7, wherein the distribution means provides the support for the non-liquid concentrate supply and the non-liquid concentrate supply sits on the distribution means, whereby liquid transmitted along the distribution means reaches the non-liquid concentrate supply supported thereon

9. The attachment of claim 7, wherein the suction inlet has a narrow front to back dimension toward and away from the user and a wide side to side dimension; the dispensing means is shaped and oriented so as to provide a drip pattern that is wide from side to side and narrow from front to back and the rod of non-liquid concentrate supply is elongated from side to side in the attachment.

10. The attachment of claim 1, wherein the suction passage has a front side and a rear side and the liquid distribution means is supported at the rear side of the suction passage.

11. The attachment of claim 10, wherein the front side of the attachment is the side away from the user in normal use and the rear side thereof is the side toward the user in normal use.

12. The attachment of claim 1, further comprising a scrubbing brush supported on the attachment and directed toward the surface, such that movement of the attachment over the surface will enable the scrubbing brush to scrub the surface.

13. The attachment of claim 1, wherein the non-liquid concentrate supply is removable from and replaceable in the attachment.

* * * * *